US008991170B2

(12) United States Patent
Sherlock

(10) Patent No.: US 8,991,170 B2
(45) Date of Patent: Mar. 31, 2015

(54) SOLAR AIR CONDITIONING HEAT PUMP WITH MINIMIZED DEAD VOLUME

(76) Inventor: Thomas Mallory Sherlock, Los Altos, CA (US)

( * ) Notice: Subject to any disclaimer, the term of this patent is extended or adjusted under 35 U.S.C. 154(b) by 296 days.

(21) Appl. No.: 13/460,767

(22) Filed: Apr. 30, 2012

(65) Prior Publication Data

US 2012/0272643 A1 Nov. 1, 2012

(51) Int. Cl.
*F02G 1/057* (2006.01)

(52) U.S. Cl.
CPC ..... *F02G 1/057* (2013.01); *F02G 2257/00* (2013.01)
USPC ..... 60/526

(58) Field of Classification Search
USPC ..... 60/518, 526, 508, 520; 165/10, 4
See application file for complete search history.

(56) References Cited

U.S. PATENT DOCUMENTS

| | | | | |
|---|---|---|---|---|
| 3,369,592 | A * | 2/1968 | Dedow | 165/10 |
| 4,442,670 | A * | 4/1984 | Goldman | 60/517 |
| 5,429,177 | A * | 7/1995 | Yaron et al. | 165/10 |
| 5,746,269 | A * | 5/1998 | Torii et al. | 165/10 |
| 5,941,079 | A * | 8/1999 | Bowman et al. | 62/6 |
| 6,131,644 | A * | 10/2000 | Kohara et al. | 165/10 |
| 6,385,973 | B1 * | 5/2002 | Moran | 60/520 |
| 6,862,883 | B2 * | 3/2005 | Kamen et al. | 60/526 |
| 7,076,941 | B1 * | 7/2006 | Hoffman et al. | 60/643 |
| 7,284,372 | B2 * | 10/2007 | Crow | 60/519 |
| 8,344,528 | B2 * | 1/2013 | Bassett | 290/1 R |
| 2006/0185631 | A1 * | 8/2006 | Fitzgerald | 123/55.5 |
| 2009/0133397 | A1 * | 5/2009 | Owens et al. | 60/520 |
| 2011/0088386 | A1 * | 4/2011 | Howard | 60/525 |

FOREIGN PATENT DOCUMENTS

JP 61014454 A * 1/1986

OTHER PUBLICATIONS

JP 61014454 A English Translation.*

* cited by examiner

*Primary Examiner* — Thomas Denion
*Assistant Examiner* — Shafiq Mian

(57) ABSTRACT

A method and apparatus that reduces the dead volume in a heat engine or heat pump, such as a duplex Stirling or Vuilleumier cycle device, by nesting the components of the displacer and regenerator such that nearly all working fluid is purged from the interstices of the regenerator elements and all other working fluid spaces that are not involved in doing useful work at each portion of the cycle. Particularly, a more scalable and efficient method and apparatus for providing solar air conditioning or refrigeration by means of a heated cylinder that alternately pressurizes and depressurizes a separate cooling cylinder by directly transferring thermally induced pressure changes to that cooling cylinder at optimized times in the cycle, under the control of a numerically controlled actuation system that can cycle at a much lower rate than mechanically coupled or harmonically phased systems.

6 Claims, 12 Drawing Sheets

SEC. A-A

SOLAR AIR CONDITIONING HEAT PUMP WITH MINIMIZED DEAD VOLUME

This application claims the benefit of provisional patent application Ser. No. 61/481,220 The following is a tabulation of some of the prior art that appears relevant. Issued U.S. patents:

| | | |
|---|---|---|
| 1,275,507 | 1918 Aug. 13 | Vuilleumier |
| 4,483,143 | 1984 Nov. 20 | Corey |
| 4,490,974 | 1985 Jan. 1 | Colegate |

Non-Patent Literature Documents

*The Regenerator and the Stirling Engine*, by Allan J. Organ, (Wiley; 1 edition, Mar. 14, 1997, 624 pages)

Kongtragool B., Wongwises S., *Thermodynamic analysis of a Stirling engine including dead volumes of hot space, cold space and regenerator, Renewable Energy,* 31 (2006) 345-359

BACKGROUND

Heat pumps and engines of the Stirling and Vuilleumier variety consist of at least two working fluid spaces, usually cylinders, that are held at different temperatures. The working fluid is fully contained within the system and displaced between the spaces either by a piston in each of the cylinders or by one or more separate displacers. In all but the simplest designs, the working fluid passes through a regenerator each time the working fluid is transferred between the spaces, giving up or taking on heat that is stored in the regenerator, from the last cycle, thereby increasing the efficiency of the system. These devices are well known it the art and are described thoroughly in the book *The Regenerator and the Stirling Engine*, by Allan J. Organ, (Wiley; 1 edition, Mar. 14, 1997, 624 pages). These systems are usually designed with high cycle rates in mind, often in the range of 1200 revolutions or cycles per minute, and therefore have comparatively open passages for fluid flow in order to avoid frictional losses. This approach allows for a high number of power cycles in a short period of time, thereby causing a mechanism of a given size and heat input to pay its way as efficiently as practicable, with regard to the fuel cost, maintenance cost, and the initial construction cost. The continuous motion of the device is usually ensured by phasing the mechanical action within the two spaces, usually at nearly 90 degrees to each other and including a flywheel or other harmonic means of inertially bringing about the next cycle.

Increased systemic 'dead volume', as described in a paper by B. Kongtragool et al (B. Kongtragool, S. Wongwises/ *Renewable Energy* 31 (2006) 345-359), limits the net work and efficiency of these systems by allowing a significant portion of the compression or expansion of the working fluid to occur in that systemic dead volume rather than specifically in the chamber, cylinder or heat transfer area that was designed to do useful work. A change in working fluid pressure taking place within the regenerator or other ducting of a Stirling or Vuilleumier cycle device, will cause a temperature change in that portion of the working fluid, but not allow that temperature change to be communicated to a heat exchanging head in order to do useful work during that particular cycle. While heat energy that changes the pressure of the working fluid in portions of the system other than at the open end of the active cylinder is not necessarily lost, it is not made useful during that particular cycle. The useful work performed during a particular cycle is proportional to the change in pressure within the total system as well as the proportion of the working fluid that is in contact with the heat transfer surface of the open end of the active cylinder. Devices of this variety are notoriously difficult to scale up into larger, more powerful devices because of the difficulty in predicting the loss in power and efficiency due to the increased dead volume and corresponding reduction in the percentage of working fluid that is in contact with the heat transfer area that can make use of the working fluid's temperature difference. Power densities and efficiencies of larger systems usually require increased complexity and cost in order to properly balance dead volume against the system's resistance to the flow of working fluid.

Materials used for the construction of heat pumps of this variety are chosen for their strength, durability and heat retention and conduction properties as well as their tendency to resist oxidation or otherwise react to the working fluid at the temperatures and pressures of any particular device. Solid conductors, heat sinks and regenerator materials range from stainless steel to cotton and are configured geometrically to transfer heat energy as advantageously as possible for a given configuration while minimizing resistance to the flow of working fluid. Regenerator materials are usually configured into wire matrices that allow for maximal contact of the working fluid with a heat retaining material that will withstand repeated cycling of temperature and flow direction. Stacked screens or other geometric matrices of stainless steel, wire, or pellets are commonly used with the intent of maximizing the heat transfer properties to and from the working fluid without excessively conducting heat between the elements of the regenerator. This is to avoid losses due to systemic longitudinal heat flow within the matrix.

The objects of the invention are as follows:

To produce more work per unit volume during each cycle of a Stirling or Vuilleumier cycle device.

To produce a device that is predictably scalable into larger, more powerful devices, without an unreasonable loss of power or efficiency.

To avoid wasting the power invested in the compression and expansion cycles of a Stirling or Vuilleumier cycle system by reducing the dead volume in various areas.

In particular, to reduce dead volume in the regenerator to zero, or nearly zero, by placing it within the displacer/regenerator space and causing interstitial spaces of the heat regenerating elements to be fully purged of the working fluid during certain portions of each cycle by collapsing the nesting elements together, thereby forcing all working fluid into the most advantageously conductive portion of the active cylinder at that particular phase and time. To reduce dead volume within the heat transfer areas by providing increased surface areas in each compression or expansion chamber that can be fully purged of the working fluid during each cycle by nesting tapered pins of the heated and cooling heads within tapered holes of the end plates of the displacer/regenerator stack.

To allow the end plates of the displacer/regenerator stack to remain in contact with the heated or cooling head while the device opens other areas of the system, thereby transferring heat to or from the end plates' surfaces, making the heating or cooling of the fluid more rapid during the next cycle.

To provide for the flexible timing of cycles and phases without requiring the continuous motion of a mechanical linkage that operates at a particular, predetermined frequency or phase angle. To provide for the timing of cycles and phases in a manner that allows for a dwell period during any particular time in the cycle, in order to allow useful work to be accomplished as fully as practicable before proceeding to the next phase of the cycle.

To provide for the timing of cycles and phases in a manner that allows for a dwell period during any particular time in the cycle, in order to allow the transfer of heat to or from the head, piston or regenerator elements, to be accomplished as fully as advantageous at any particular temperature, pressure, flow rate and cycle rate before proceeding to the next phase of the cycle.

To provide for the timing of cycles and phases in a manner that allows any given chamber to open or close as fully as advantageous before any other chamber begins to open or close. To provide for timing of cycles and phases that allows any given chamber to begin to open or close at the most advantageous time in any given cycle, based on an algorithm that optimizes the timing according to the temperature, pressure, flow rate, cycle rate and positions of various portions of the system, according to sensors in those areas.

To reduce fluid frictional losses by cycling at a rate no greater than necessary to accomplish the presently assigned task, thereby allowing the minimization of working fluid passageway cross sectional areas and their associated dead volumes, whether inside or outside the regenerator.

To provide for timing of cycles and phases without requiring the addition of dead volume to accommodate the timing mechanism.

To reduce mechanical friction and working fluid pressure losses by avoiding the penetration of the sealed system by mechanical shafts or linkages.

To reduce longitudinal heat conduction through the regenerator elements by interleaving the regenerator elements with insulating material of similar geometry.

To prevent eddy currents from forming within the regenerator matrix by purging all working fluid from the matrix during each cycle, thereby stopping the flow of the working fluid at least momentarily, during at least a portion of each cycle.

To allow the pressure changes in one, heated/driving system, to be communicated to, and used directly in, another similar driven/cooling system, in order to avoid losses associated with the transformation of energy to and from its various forms, such as thermal, electrical, mechanical and chemical.

To allow for multiple heat sources for the heating of the driving portion of the device, including solar thermal heating as well as electrical, gas or waste heat from a process, building or vehicle. To allow for alternative power sources for the mechanism drive, including self generated internal pressures, an electric motor or solenoid, or a separate heat engine that is also powered by solar thermal, natural gas or waste heat.

To allow waste heat from the warm side of both driving and driven cylinders to be reused for other purposes, such as water heating.

To allow for the connection of this system's data processing unit to the system control of an associated building or process, to better integrate all systems efficiently.

To allow for the operation of the system as a building heating unit by reversing the phase of the second, driven cylinder in relation to the first.

To allow for excess power to be used as mechanical power to generate electricity or pump liquid by driving a piston or pistons with the pressure from the driving cylinder.

DESCRIPTION

This invention relates to heat engines and Stirling cycle devices, and more particularly to heat driven duplex Stirling coolers and Vuilleumier heat pumps having regenerators. Existing Stirling cycle engines and heat pumps contain dead volumes, primarily in the heat exchanger and regenerator areas to provide space through which the working fluid may pass on its way to another chamber, while gaining or releasing heat energy. The presence of excess dead volume is undesirable because it dilutes and lowers the extremity of pressure changes in areas of the device that are capable of accomplishing useful work during a given cycle. (Kongtragool B., Wongwises S., *Thermodynamic analysis of a Stirling engine including dead volumes of hot space, cold space and regenerator, Renewable Energy,* 31 (2006) 345-359) Typically the design of a Stirling cycle device must be a balance of surface areas and volumes, in open areas of the device, to allow for sufficient heat transfer without creating either excessive losses due to restriction of fluid flow or excessive dead volumes in these areas. It has historically been difficult to eliminate much of the dead volume within these fixed, open areas. A further problem associated with regenerators of fixed volume is that standing eddy currents can arise that act as short circuits to the heat cycle and rob the regenerator of its contribution to efficiency by allowing cooled fluid to travel one direction within one area and hot fluid to travel in the opposite direction within another area. This defeats the heat recovery purpose of the regenerator in these areas.

Figure 1:
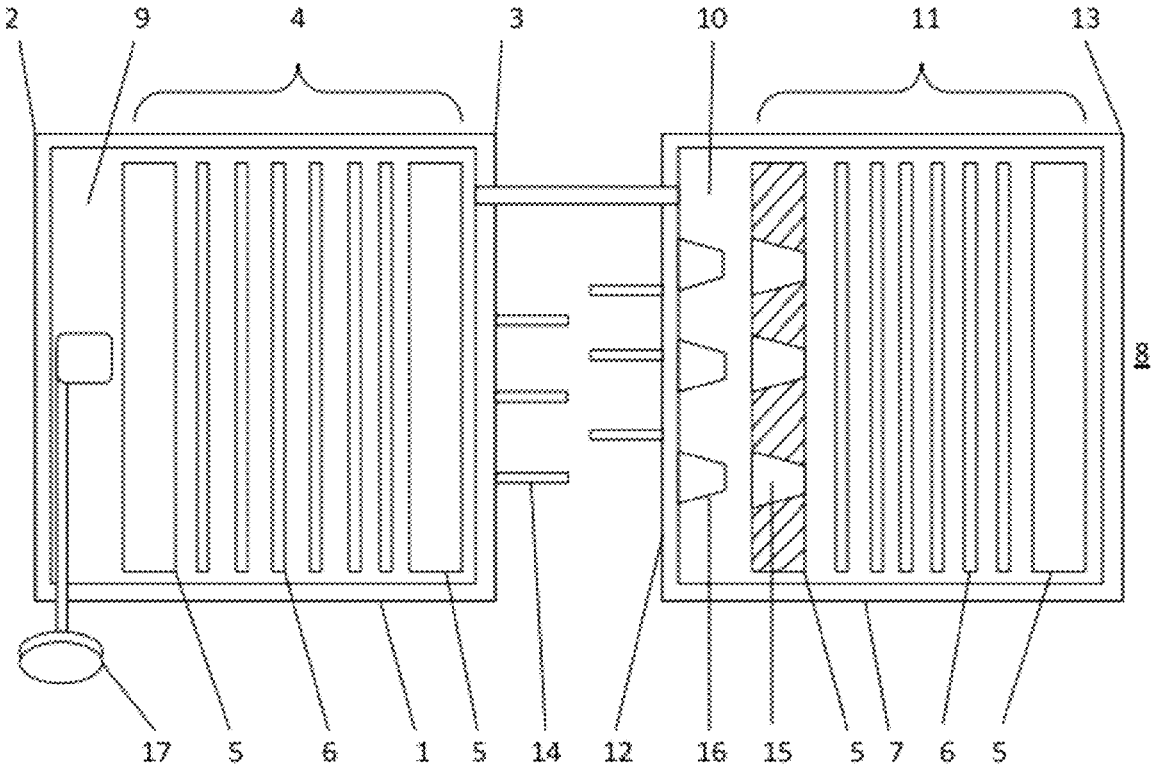
FIG. 1 shows a schematic diagram of the device configured as a heat pump.

The present invention involves Stirling cycle related devices, particularly a heat pump that comprises two cylinders. Referring to FIG. 1, a first, driving/heated cylinder (1) is heated on one end, through a heated head (2), and cooled on the other end, through a cooled head (3). A displacer/regenerator stack (4), comprising two end plates (5) and a plurality of nesting inner displacer/regenerator layers (6), is expanded and collapsed alternately toward opposite ends of the heated cylinder (1) by one of two timing/actuation means (17), thereby creating an alternating pressure within the heated cylinder (1). A second, similar cooling cylinder (7), is driven by alternating pressure of the first, driving/heated cylinder (1), and cools a specific living space (8), or refrigerating compartment, by using the alternating pressure from the driving/heated cylinder (1) to pump heat from the space to be cooled. The thermal pressurization of working fluid in the heat exchange cavity (9) of the driving/heated cylinder is used directly, to compress working fluid in the warm end heat exchange cavity (10) of the driven/cooling cylinder (7), thereby driving heat off that end. The driven/cooling cylinder (7) also contains a displacer/regenerator stack (11) similar to that in the driving/heated cylinder (1). Displacer/regenerator stacks (4, 11) in each of the cylinders, each comprise two end plates (5) that capture a plurality of nesting displacer/regenerator layers (6) that are constructed from, or plated with, a heat retaining material such as a metal. Each of the end plates and layers are constructed such that that when the stack is forced together, all interstitial spaces are closed, thereby eliminating what would otherwise be dead volume. This leaves space in only one of each cylinder's heat exchange cavities that usefully transfers heat between the working fluid and a head. Heat in the working fluid is thereby recovered, stored, and regenerated during a subsequent phase of a given cycle without the dilution of compression and the associated loss of power that would usually occur due to the dead volumes that would be left open in traditional heat exchanger passageways and static, porous regenerators.

Each cylinder assembly (1, 7) comprises a cylindrical container with a heat conducting head (2, 3, 12, 13) on each end. In the preferred embodiment, the heated head (2) of the driving/heated cylinder (1) may accommodate external components appropriate to take on heat from radiant heat sources such as the sun, including reflectors that collect and concentrate the radiant heat energy, and insulating windows that prevent radiant and conductive losses. The head may also have geometry to receive supplemental heat from other sources such as hot liquid, a flame, or an electrically heated element for operation during periods that lack sufficient direct solar radiation. The other cylinder heads may have appropriate heat exchange geometry such as finned surfaces (14), adequate to transfer heat to or from the ambient environment in their immediate areas. The ambient air or other medium may be driven across the fins of these heads by fans or pumps, depending on the necessity to do so at the time.

An end plate (5) at each end of each displacer/regenerator stack (4, 11), is a piece of heat conductive material that is significantly thicker than the other layers of the stack. It is in contact with a timing/actuation means (17) that compresses the stack from either end of the associated cylinder at the correct time in the cycle. Each of these end plates (5) has a plurality of tapered holes (15). Each of these holes surrounds a similarly shaped pin (16) that protrudes from its adjacent head, increasing the surface area of the heat exchanger cavity (9, 10) compared to its volume when open. The tapered holes (15) also allow the pins (16) to protrude through each end plate (5). The inner side of the end plate that is in contact with the first thin displacer/regenerator layer on that end, is shaped such that it nests against the first displacer/regenerator layer as if it were another layer itself. The ends of the associated head's heat exchanger pins that protrude through the holes of the end plate (5) are likewise formed to nest with the next thin displacer/regenerator layer. This may be accomplished by nesting a plate (5) against its associated head and machining the profile of the subsequent layer into the mated head-plate assembly, thereby ensuring proper nesting of all three parts. This allows communication of working fluid from within the regenerator stack to the head's heat exchange area when the timing/actuation means compresses the stack from one end, and allows the working fluid back into the stack when the stack is no longer compressed by the timing/actuating means (17). The stack is expanded by a spring means that may be the shape preloading of the individual layer elements into a saddle shape similar to the geometry of a potato chip. Another spring means that is easily accommodated by this configuration includes wave spring washers (27) that nest within circular recesses (28) in each layer. The timing/actuation means (17) works against the spring means to compress the head/plate/regenerator engagement to one end of the cylinder, thereby eliminating nearly all dead volume in that area, at that time, and forcing nearly all working fluid into the open area at the other end of the cylinder.

The inner displacer/regenerator layers (6) comprise disks of heat retaining materials that are thin enough to take on, and give up heat readily but are not so fragile that they can be damaged by extended exposure to heat and slight bending. An overall thickness of two millimeters is practical in many metals, giving each grid element a cross sectional area of approximately one square millimeter in the trapezoidal prism configuration that is most clearly seen in FIGS. 4 through 8. Appropriate materials for the construction of these layers include those that would be suitable for high temperature spring materials such as; copper alloys, brass alloys, bronze alloys, stainless steel alloys, titanium alloys, nickel-chromium alloys such as Inconel®, nickel-copper alloys such as Monel®, as well as aluminum alloys, high temperature plastics, fiber reinforced plastics, ceramics, and graphenes. Layers of less conductive materials, such as high temperature plastics, may be interleaved between the conductive layers to offer insulation between them in order to minimize the longitudinal flow of heat through the solid material of the stack while it is nested tightly. High temperature plastics may also be plated with materials of higher conductivity, such as copper or aluminum in order to retain heat at the surface of the layer without drawing heat so far into the structure of the material that it cannot be made useful during the next cycle.

Each head contains a timing/actuation means (17). When any constraining force from one of the timing/actuation means is released, the stack in that cylinder expands, due to pressure exerted between the layers by the separate springs (27) or integral spring properties or features formed into each layer. The stack then fills the cylinder between the two ends of the cylinder, allowing the working fluid to flow back into the interstices of the displacer/regenerator stack. Each time the displacer/regenerator stack is purged or refilled, the flow is stopped, thereby preventing ongoing eddy currents from forming.

The timing/actuation means (17) comprises shaft driven cams, sliding plates, memory wire springs, or solenoids that contact each end plate and, when at rest, fill their respective travel volumes, thereby avoiding the creation of dead volume in spaces other than working fluid areas that are in use at a particular time. In one preferred embodiment, the timing/actuation means comprise cams that are driven by shafts that each pass through a seal on each head. In another preferred embodiment, there is provided a timing means, in each head, that is magnetically driven from outside a hermetically sealed system, thereby reducing mechanical losses associated with running seals around drive shafts, and further reducing the loss of working fluids such as helium. In relatively low temperature applications, solenoids may be used within the cylinder. In some rudimentary, low cost embodiments, memory wire such as nickel-titanium alloy may be used to actuate a cycle at the proper time, when the programmed reaction temperature of the memory wire is attained, thereby changing the state of the memory wire to spring mode rather than passive mode and thereby creating a compressing end force on the stack of displacer/regenerator elements.

In the preferred embodiment, the cycles of the system are actuated by solenoids or linkages which in turn are controlled by an electronic control system (18) according to algorithms that ensure adequate time for heat transfer in any particular space depending on the particular temperatures and pressures in the system at that particular time. There is no predetermined phase angle between the components as is usually encountered in devices of this variety that are driven by a predetermined harmonic or phased rotational motion.

The electronic control system (18) causes each of the timing/actuation means (17) to bring about a sequence of actions, in the proper order, at the appropriate time and actuation speed to gain efficient performance, at any given set of sensed temperatures and pressures. Appropriate dwell times, between actions, allow for adequate and efficient heat transfer. The effect of the sequence of commands from the electronic control system (18) to the timing/actuation means (17) is to;

1. Push the displacer/regenerator stack (11) away from the warm head (12) of the driven/cooling cylinder (7), opening a heat exchange cavity (10) to receive pressurization.
2. Push the displacer/regenerator stack (4) away from the heated head (2) of the driving/heated cylinder (1), opening a heat exchange cavity (10) to accommodate working fluid that will be heated to create pressurization. (This heats working fluid that has come in contact with the heated head and the holes of the end plate adjacent to the headed head, pressurizing the system, causing heat to be driven from the warm head (12) of the driven/cooling cylinder (7).)
3. Relax both displacer/regenerator stacks (4, 11), filling both cylinders with expanded displacer/regenerator stacks and the interstitial spaces between regenerator elements, thereby drawing the working fluid into the interstices of the displacer/regenerator stacks.
4. Push displacer/regenerator stack (11) away from cooling head (13) of the driven/cooling cylinder (7), opening a space that will allow working fluid in that space to experience de-pressurization in order to take on heat from the living space (8) or a cooling appliance.
5. Push the displacer/regenerator stack away from cooled head (3) of the driving/heated cylinder (1), opening a space to produce the de-pressurization that will be used to cool the cooling head (13) of the driven/cooling cylinder (7). (The cylinders now communicate their pressures. The hot cylinder cools the working fluid that has come in contact with its cooled head, de-pressurizing the system, causing heat to be pulled from the cooling head (13) of the cooling cylinder (7), thereby cooling the living space (8) or cooling appliance.)
6. Relax both displacer/regenerator stacks (4, 11), filling both cylinders with expanded displacer/regenerator elements, thereby drawing the working fluid into the interstices of the regenerator layers.
7. Repeat cycles 1-6 while adjusting for any changes in temperatures, pressures and load.

Figure 2:
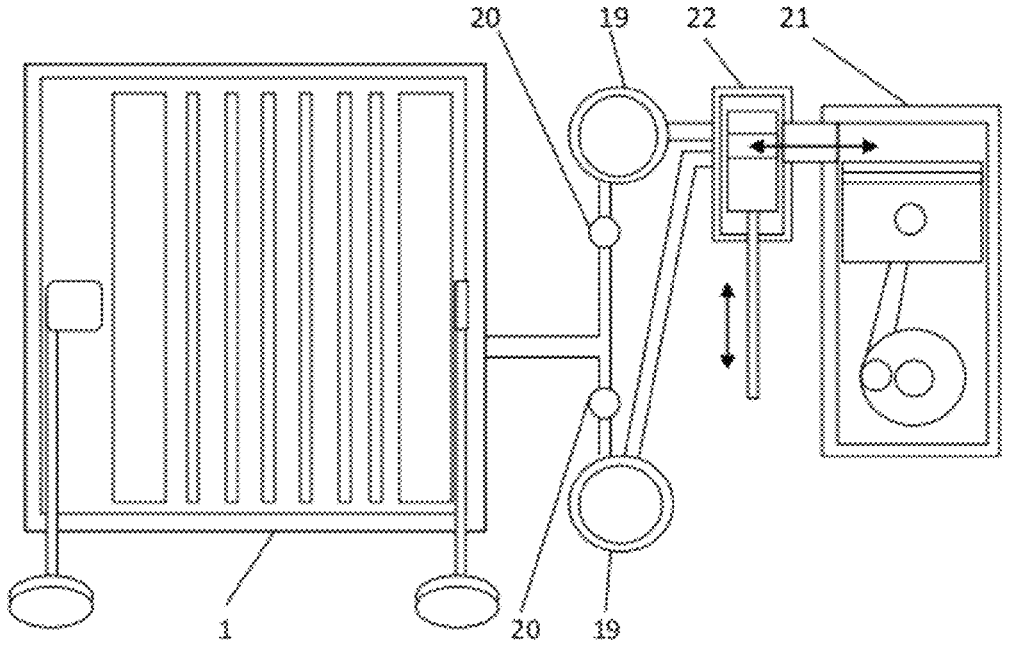
FIG. 2 shows a schematic diagram of the device configured as an engine.

Referring now to FIG. 2, the heated/driving cylinder (1) is shown schematically driving a motor rather than a heat pump. The driving/heated cylinder charges two tanks (19). One is pressurized and the other is depressurized through the use of two check valves (20). A pressure motor (21), of any appropriate variety, is driven by the pressure difference between the tanks. The motor's speed is controlled by valve (22), which may be driven by cam, solenoid, governor or other means. Appropriate tanks, valves and pressure engines are well known in the art.

Figure 3:
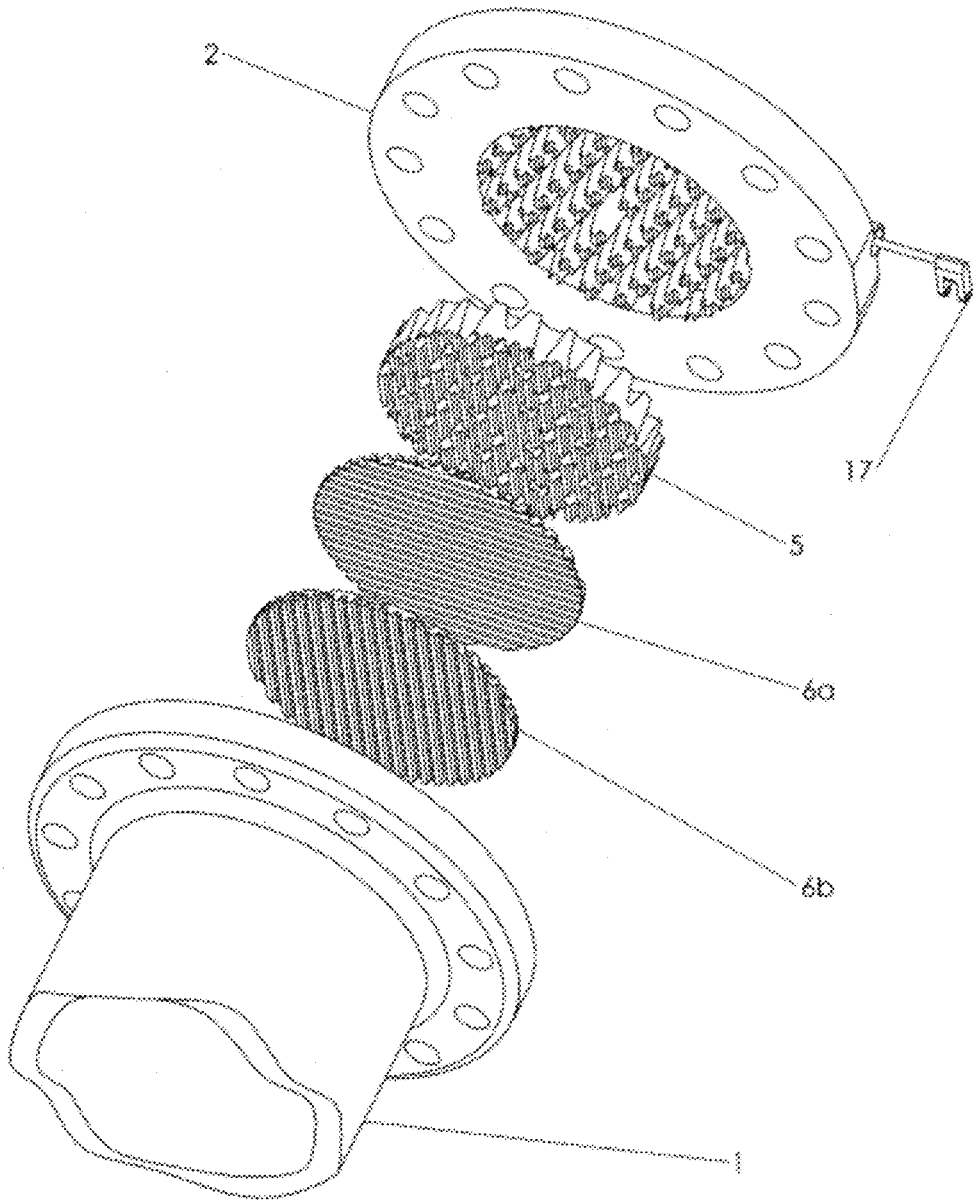
FIG. 3 shows the driving/heated head and the mating end plate of the displacer/regenerator stack with the individual displacer/regenerator layers below as they are stacked in the cylinder.
Figure 4:
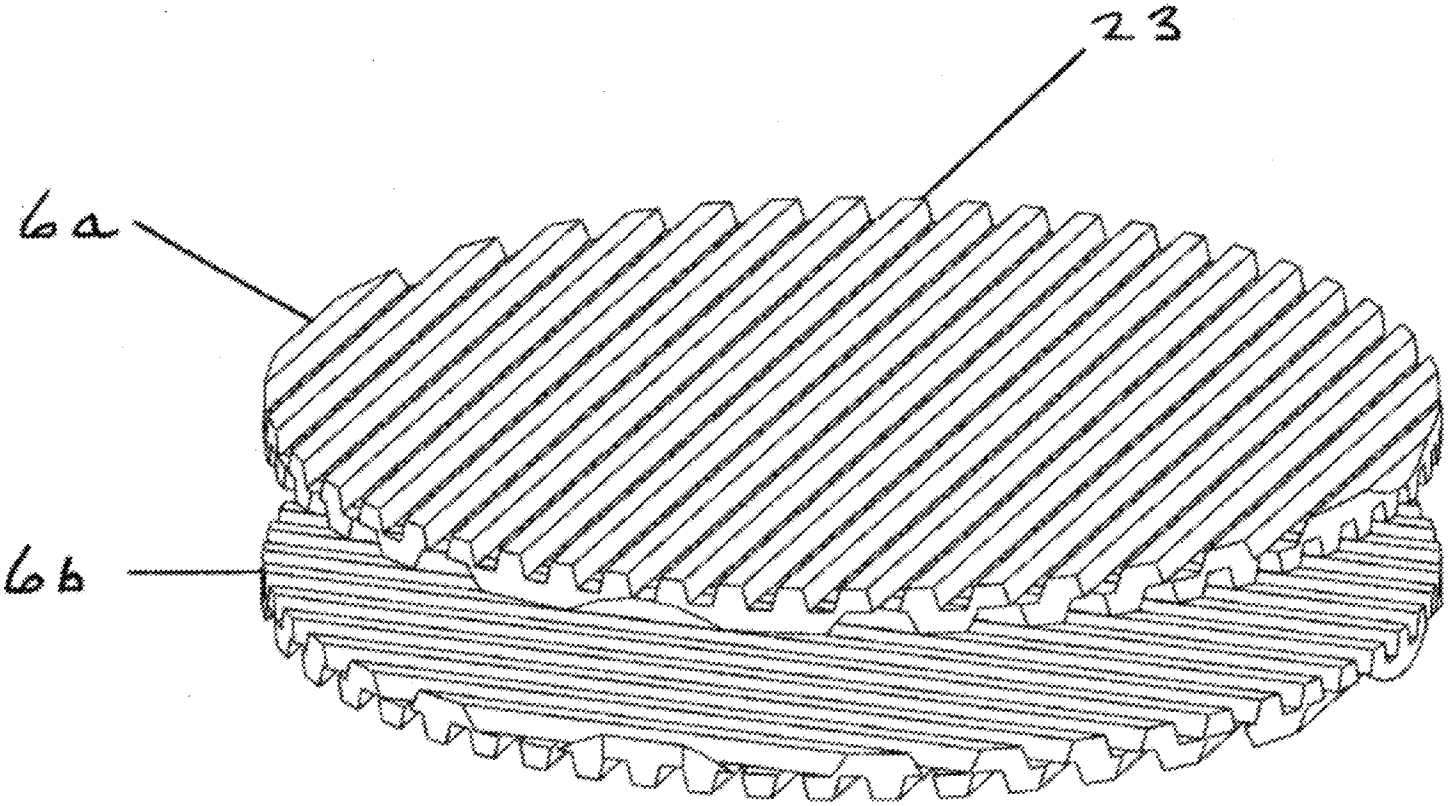
FIG. 4 shows two elements of the displacer/regenerator stack, configured in the form of grids constructed of trapezoidal prisms.

Referring now to FIGS. 3 and 4, two layers (6*a*, 6*b*) of a displacer/regenerator stack (4, 11) are shown in a position further apart than they would normally occupy in the assembly. A plurality of trapezoidal prisms (23) make up each side of each layer. The prisms on one side of a layer are oriented at 90 degrees to the prisms on the other side, leaving square openings through which working fluid will pass during operation. In low quantities, these layers are manufactured by machining grooves half way through a thermally conductive material of a certain thickness, and then turning the layer over and machining similar grooves on the other side, at right angles to the grooves on the first side, half way through the material, leaving the square openings when the tool breaks through into the grooves of the first side. These layers can also be made by other processes such as etching, electroforming, molding, coining, furnace brazing of preformed wire, or sintering from powdered materials.

Figure 5:
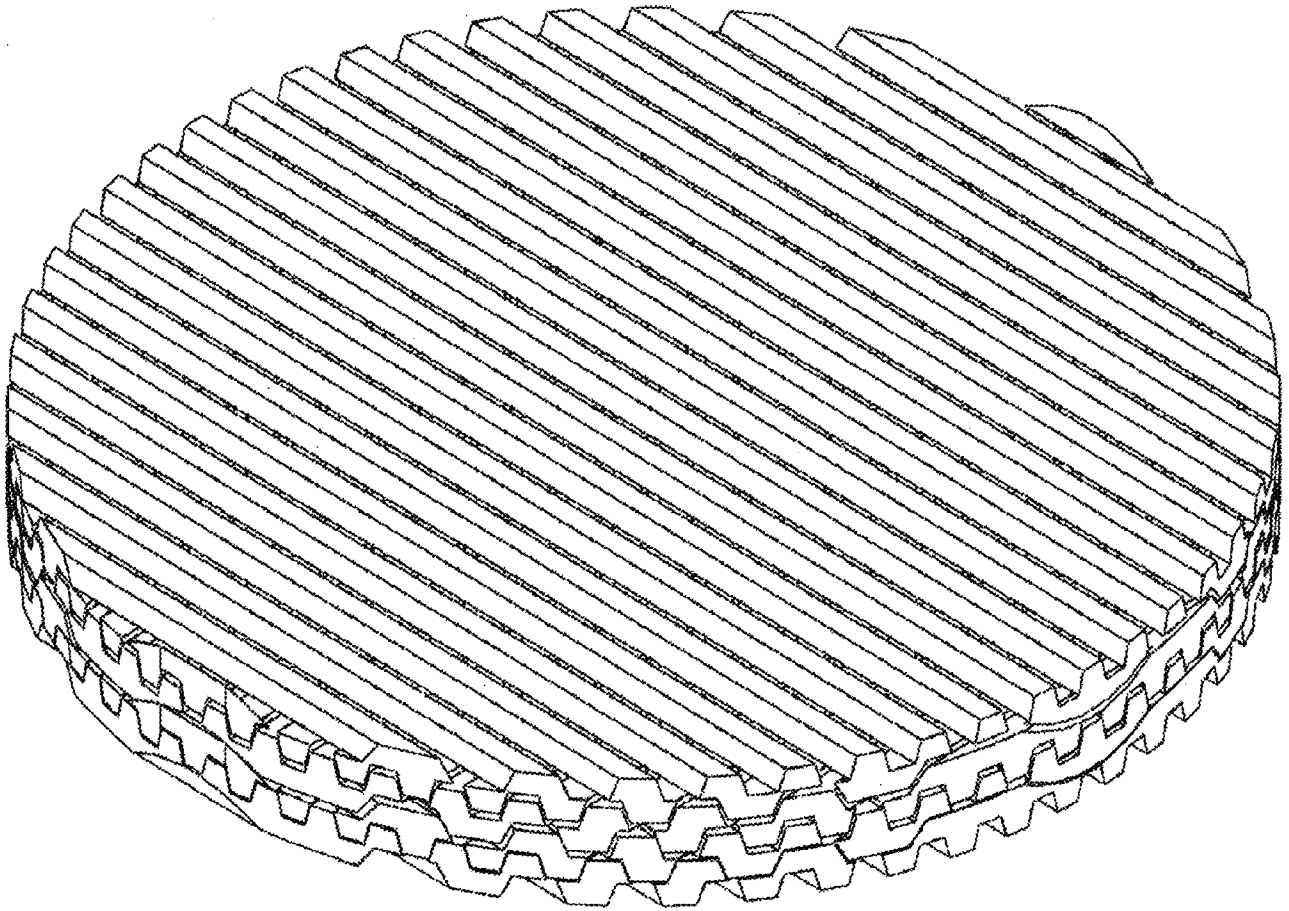
FIG. 5 shows four elements of the displacer/regenerator stack, configured in the form of grids of trapezoidal prisms, partially nested, but with some interstitial space between them.

Referring now to FIG. 5, four layers a the displacer/regenerator stack (4, 11) are shown in a position of nearly full engagement. The trapezoidal prisms of any given layer are occupying the spaces between the trapezoidal prisms on the adjacent layer. Working fluid continues to flow through the matrix until the nesting layers are fully engaged. At full engagement, flow of the working fluid stops, except for minor flow due to some continuing pressure changes and slight leakage.

Figure 6:
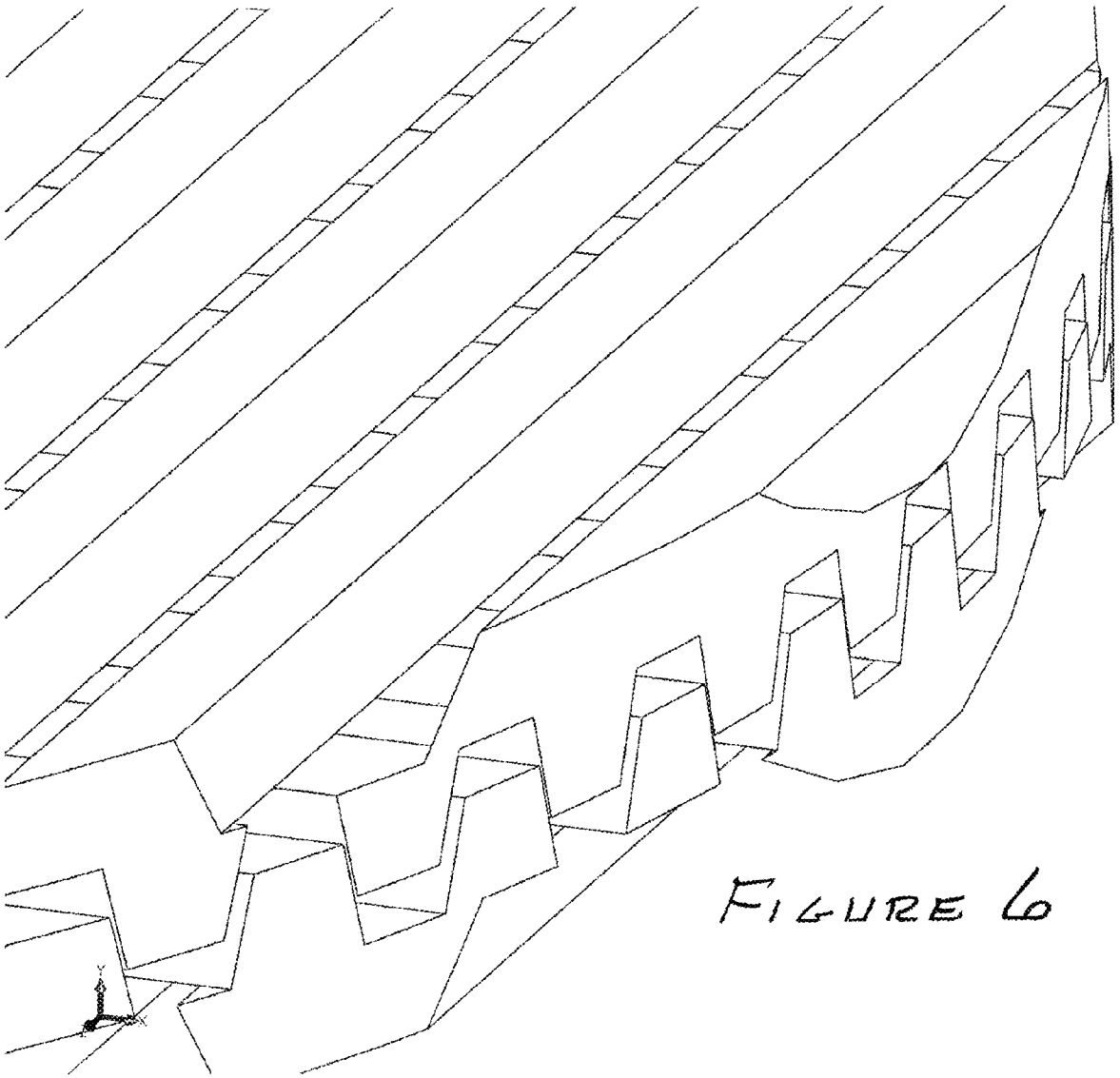
FIG. 6 shows the geometric edge detail of two displacer/regenerator layers nested partially.

Referring now to FIG. 6, a detail of two layers is shown. As in most other views, no outer ring, skirt or flange is shown for purposes of clarity.

Figure 7:
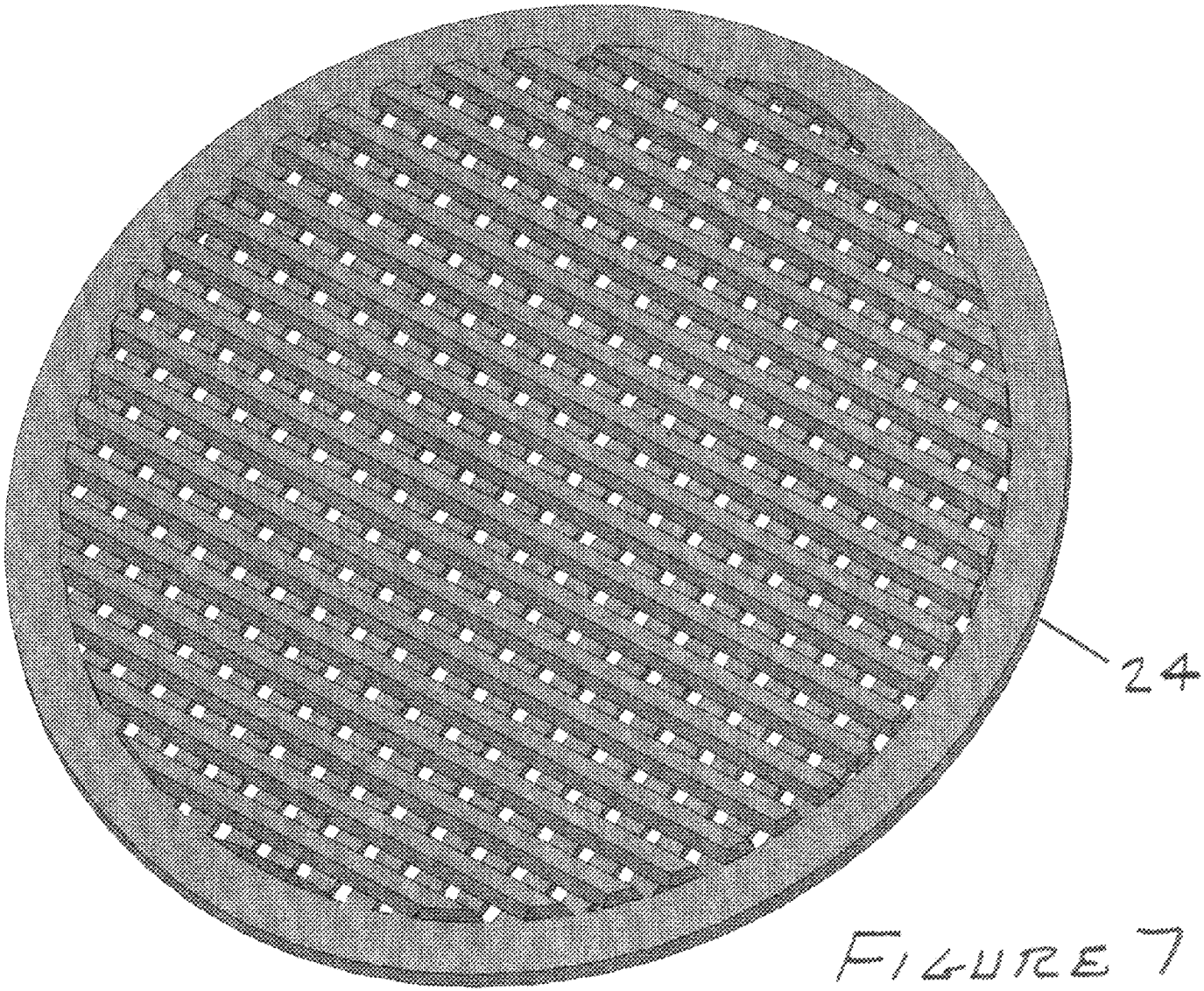
FIG. 7 shows one element of the displacer/regenerator stack with a circumferential skirt that provides a smooth surface to bear against the inner surface of the cylinder wall. This skirt feature is eliminated in other views in order to show the geometry of the layers more clearly.

Referring now to FIG. 7; In production devices, each layer (6) has a circumferential skirt (24) that is half as thick as the overall thickness of the layer itself, for the purpose of protecting the ends of the individual prisms, or other geometry, and providing a smooth surface to bear against the inner surface of the cylinder wall. This skirt is also an area that can contain the spring means for the separation of the layers when the timing/actuation means (17) is relaxed.

Figure 8:
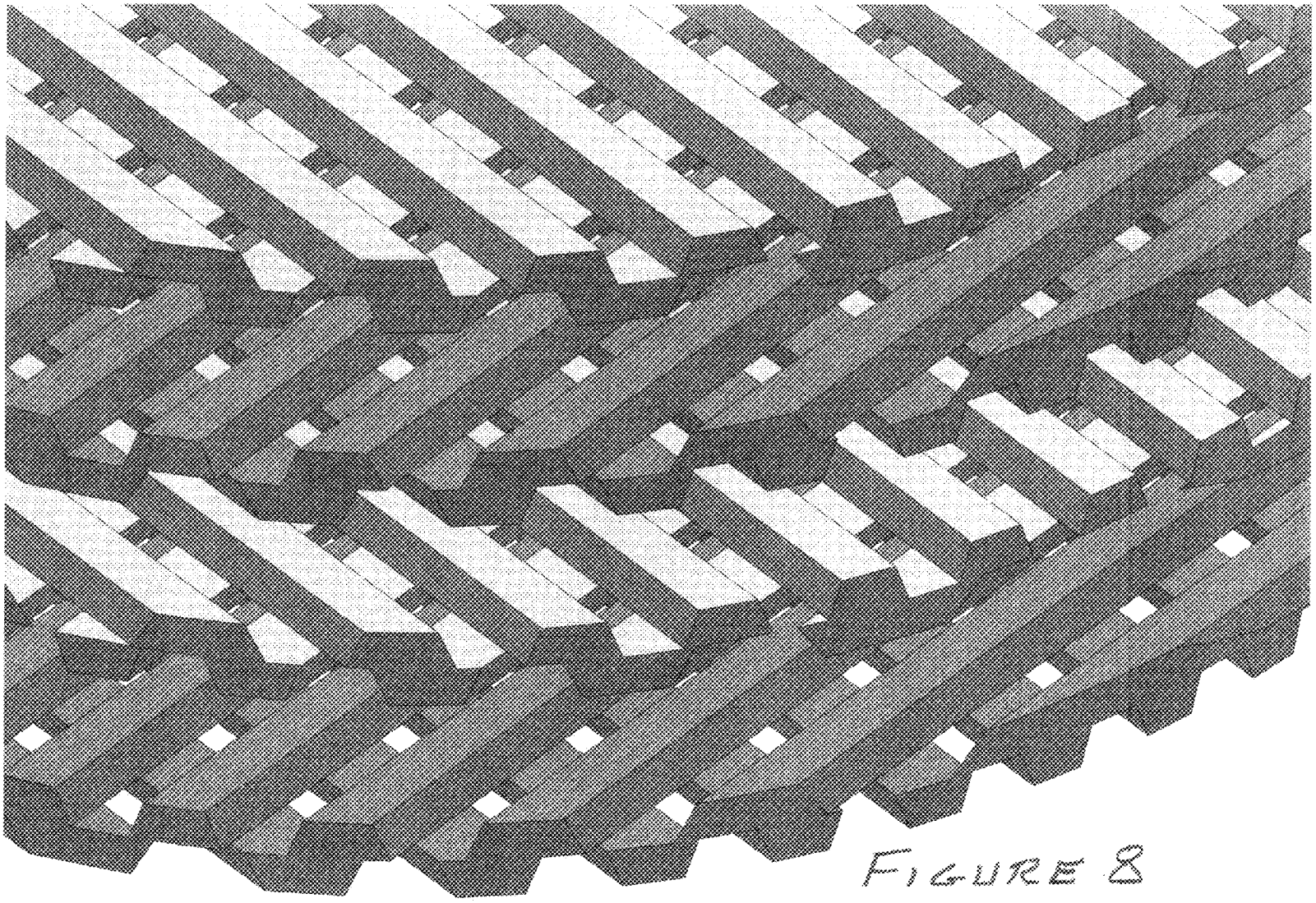
FIG. 8 shows a shaded edge detail of four displacer/regenerator elements expanded to better show the nesting geometry of the trapezoidal prism grids.

Referring now to FIG. 8, four layers are shown exploded apart and shaded to show the nesting geometry. Again the circumferential skirt is eliminated to better show the nesting geometry.

Figure 9:
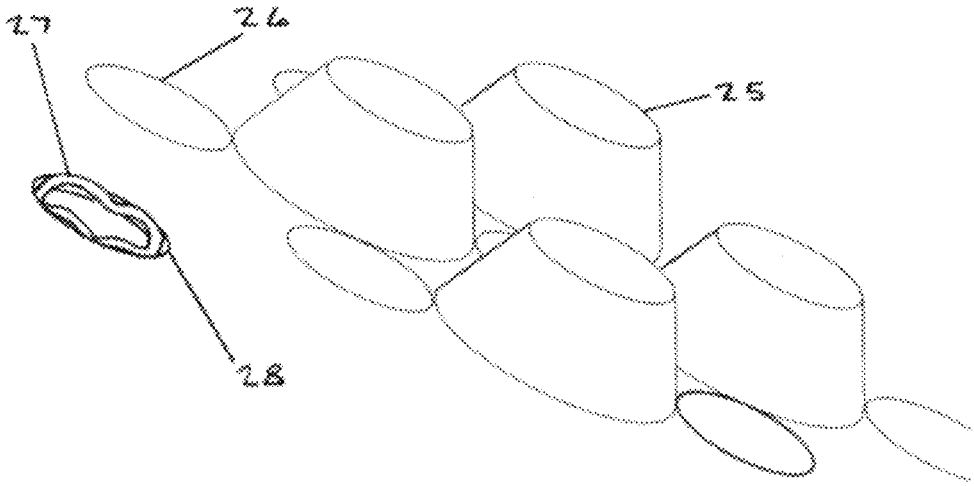
FIG. 9 shows the upper surface geometry of another embodiment of one of the nesting elements of the displacer/regenerator in the form of a sheet having truncated conical holes and matching truncated conical bumps in a square pattern. A recess that holds a wave spring washer is also shown.

Referring now to FIG. 9, the partial surface of another displacer/regenerator layer geometry is shown that comprises truncated conical bumps (25) that are oriented in a square pattern. Conical holes (26) on the lower surface of layers of this embodiment accommodate similar bumps on the top of the adjacent layer below, allowing for working fluid flow until fully engaged, at which time all working fluid is purged from the interstices of the stack. A wave spring washer (27) is shown in a circular recess (28). This is one means of separating the layers when the timing/actuation means releases pressure on the stack.

Figure 10:
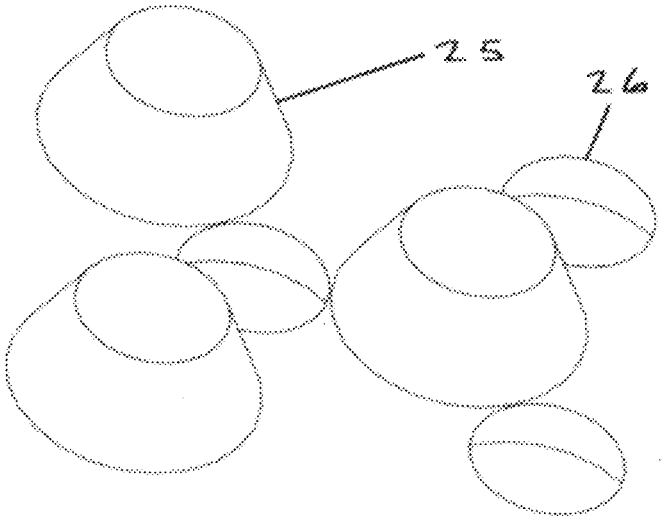
FIG. 10 shows the upper surface geometry of another embodiment of one of the nesting elements of the regenerator in the form of a sheet having truncated conical holes and matching truncated conical bumps in a triangular pattern.

Referring now to FIG. 10, a similar geometry is shown depicting truncated conical bumps and holes in a triangular pattern.

Figure 11:
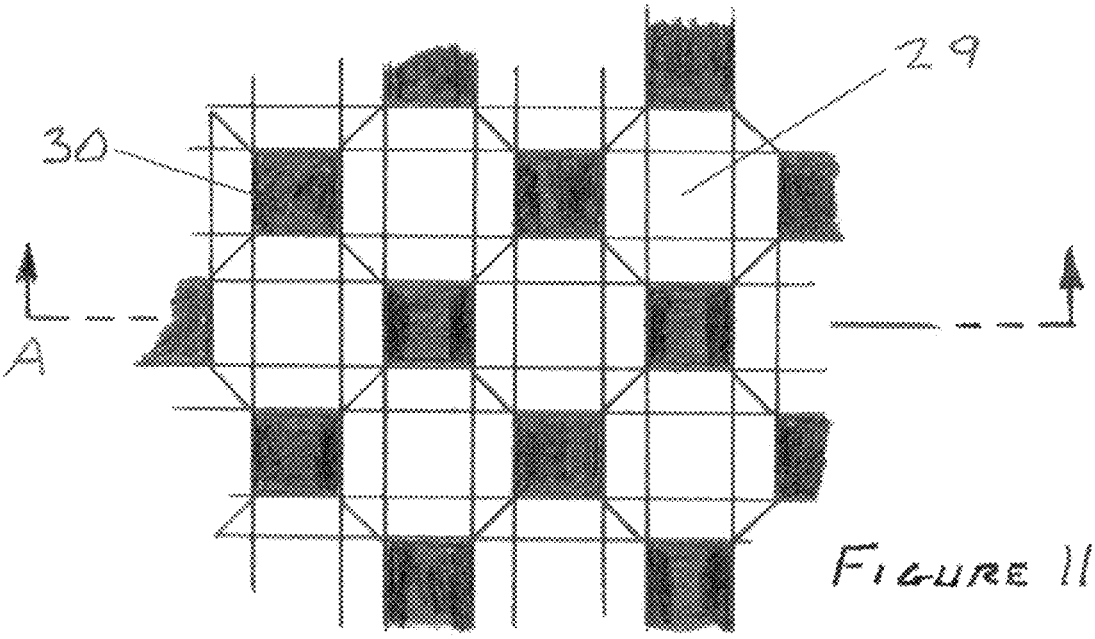
FIGS. 11, 12 and 13 show another embodiment of one of the nesting elements of the displacer/regenerator in the form of square cupolas and holes matching that shape in a square pattern.

Referring now to FIG. 11, a similar geometry is shown in which the bumps and holes are in the form of square cupolas (29), and holes (30) matching that shape, in an offset square pattern. The black areas depict the open areas that will be plugged by the tops of the square cupolas that reside on the adjacent layer below and rise into the square cupola shaped holes in the far side of the visible part.

Figure 12:
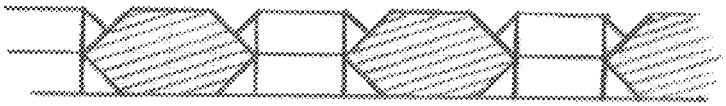

Referring now to FIG. 12, a cross section of the square cupola geometry is shown as cut through the section A-A in FIG. 11.

Figure 13:
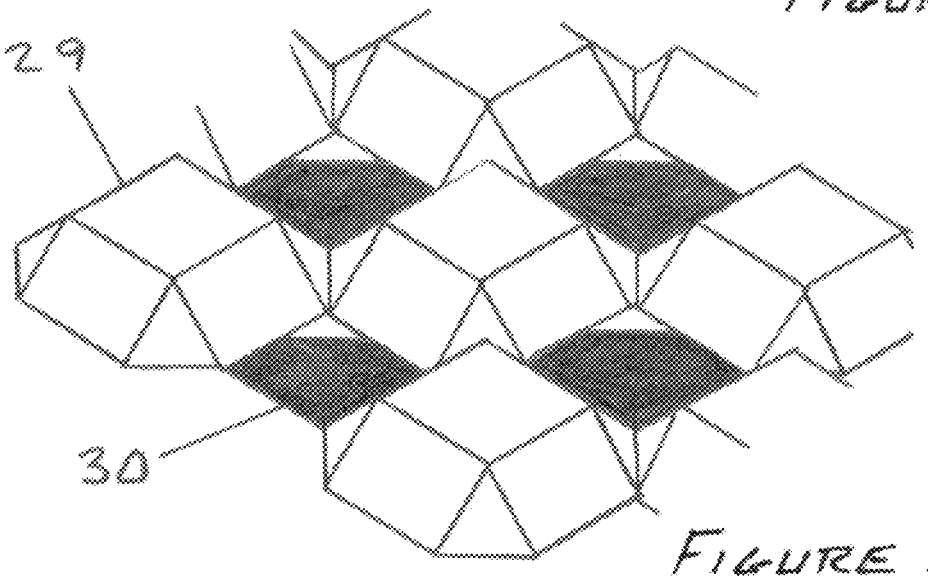

Referring now to FIG. 13, an isometric view of the square cupola geometry is shown.

Other geometries may be used such as sheets of nesting louvers. The requirement is that the geometry of the top side of one layer fully fills the complementary geometry of the bottom side of the adjacent layer leaving holes that allow working fluid to flow through the stack until full engagement of the nesting layers is complete.

Figure 14:
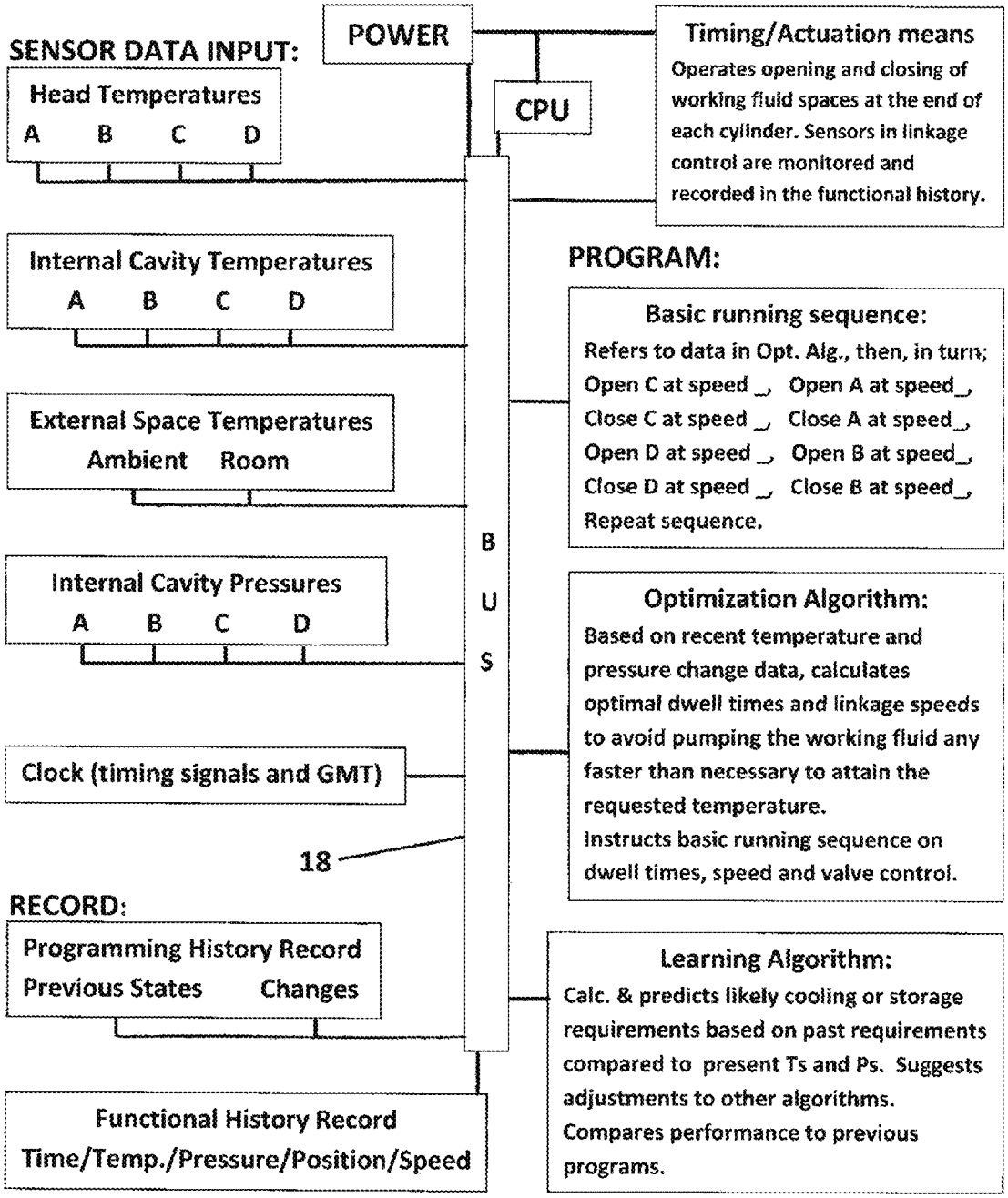
FIG. 14 shows a diagram of the electronic control system.

Referring now to FIG. 14, a diagram of the electronic control system (18) is shown in which a central processing unit controls the timing/actuation means. Times and rates of actuation are calculated for optimum performance based upon data from temperature and pressure sensors mounted in various areas of the system and in the ambient environment. The history of operation is recorded regarding time, date, load requirement, and previous actions used to meet those needs. This data is used for efficiency decisions made by the CPU and to aid in troubleshooting and reprogramming by service personnel.

Figure 15:
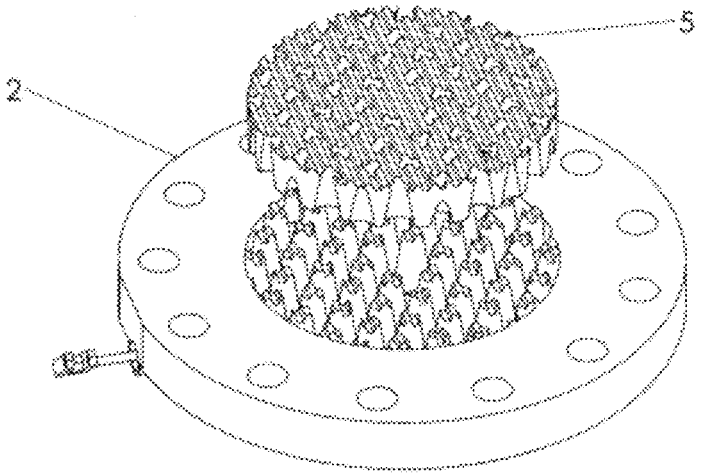
FIGS. 15 and 16 show the nesting of one of the end plates into one of the heads.
Figure 16:
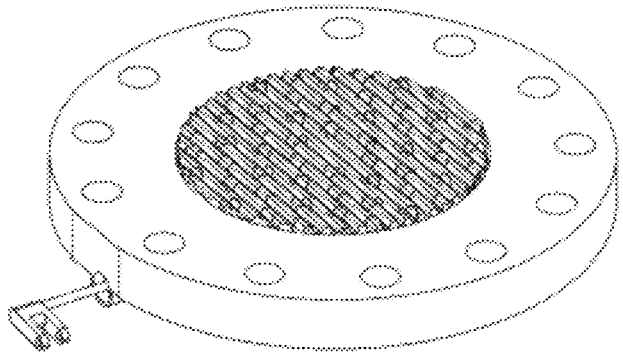
Figure 17:
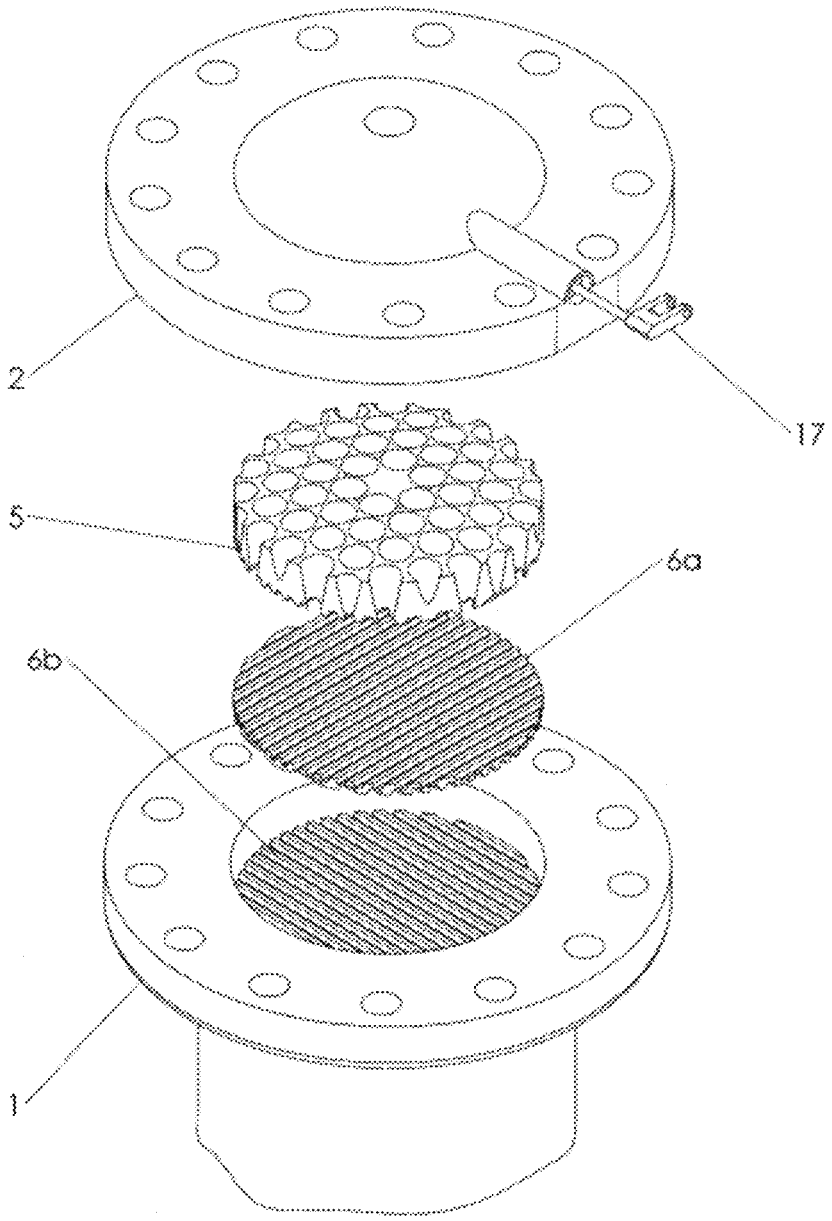
FIG. 17 shows an exploded view of the assembly of the heated head and the plate and adjacent layers into the cylinder, from another angle.

In FIGS. 15 and 16 the head (2) and plate (5) are shown, first apart in FIG. 15, and then fully nested in FIG. 16. The continuous grooves formed by the profile of the ends of the tapered pins protruding through the similarly shaped surface of the plate will fully nest with the next thin layer (6) of the stack. FIG. 17 offers an exploded view of the heated head side of the plate, showing the other side of the holes in the plate that nest with the pins in the head.

The invention claimed is:

1. A heat exchanging regenerator element comprising:

an approximately planar sheet of solid material having holes for passing working fluid and having surface geometry that nests closely within complementary surfaces of similar adjacent heat exchanging regenerator elements such that said holes are closed and interstitial spaces are filled with the solid material of adjacent heat exchanging regenerator elements when the similar adjacent heat exchanging regenerator elements are forced together; and a slightly deformed planar geometry that springs out of the planar configuration into a saddle shape and resists nesting with other heat exchanging regenerator elements of similar geometry unless forced into a planar configuration.

2. A heat exchanging regenerator element comprising:

an approximately planar sheet of solid material having holes for passing working fluid and having surface geometry that nests closely within complementary surfaces of similar adjacent heat exchanging regenerator elements such that said holes are closed and interstitial spaces are filled with the solid material of adjacent heat exchanging regenerator elements when the similar adjacent heat exchanging regenerator elements are forced together; and wherein the heat exchanging regenerator element further comprises a recess that holds a wave spring washer that springs out of a planar configuration thereby preventing the heat exchanging regenerator element from nesting with other heat exchanging regenerator elements of similar geometry unless said wave spring washer is forced into a planar configuration.

3. A heat exchanging regenerator element comprising:

an approximately planar sheet of solid material having holes for passing working fluid and having surface geometry that nests closely within complementary surfaces of similar adjacent heat exchanging regenerator elements such that said holes are closed and interstitial spaces are filled with the solid material of adjacent heat exchanging regenerator elements when the similar adjacent heat exchanging regenerator elements are forced together; and wherein the heat exchanging regenerator element further comprises a grid constructed from a first layer and a second layer, each layer comprising a plurality of equidistant and parallel trapezoidal prisms, these layers being permanently joined such that the bases of said parallel trapezoidal prisms in said first layer are fused with the bases of the parallel trapezoidal prisms of said second layer, wherever they cross, parallel trapezoidal prisms of said first layer being more or less perpendicular to the parallel trapezoidal prisms of said second layer.

4. A heat exchanging regenerator element comprising:

an approximately planar sheet of solid material having holes for passing working fluid and having surface geometry that nests closely within complementary surfaces of similar adjacent heat exchanging regenerator elements such that said holes are closed and interstitial spaces are filled with the solid material of adjacent heat exchanging regenerator elements when the similar adjacent heat exchanging regenerator elements are forced together; and wherein the heat exchanging regenerator element further comprises a plurality of truncated conical holes and matching truncated conical bumps in a repeating pattern.

5. A heat exchanging regenerator element comprising:

an approximately planar sheet of solid material having holes for passing working fluid and having surface geometry that nests closely within complementary surfaces of similar adjacent heat exchanging regenerator elements such that said holes are closed and interstitial spaces are filled with the solid material of adjacent heat exchanging regenerator elements when the similar adjacent heat exchanging regenerator elements are forced together; and wherein the heat exchanging regenerator element further comprises polygonal cupolas and holes matching that shape in a repeating pattern.

6. A heat exchanging regenerator element comprising:

an approximately planar sheet of solid material having holes for passing working fluid and having surface geometry that nests closely within complementary surfaces of similar adjacent heat exchanging regenerator elements such that said holes are closed and interstitial spaces are filled with the solid material of adjacent heat exchanging regenerator elements when the similar adjacent heat exchanging regenerator elements are forced together; and wherein the heat exchanging regenerator element further comprises a plurality of louvers in a repeating pattern.

* * * * *